US010967284B2

(12) United States Patent
Koide et al.

(10) Patent No.: US 10,967,284 B2
(45) Date of Patent: Apr. 6, 2021

(54) INFLATABLE SURFING APPARATUS

(71) Applicant: Whitewater West Industries Ltd., Richmond (CA)

(72) Inventors: Brad Jiro Koide, San Diego, CA (US); Danny Philp, KWA—Zula Natal (ZA)

(73) Assignee: Whitewater West Industries Ltd.

( * ) Notice: Subject to any disclaimer, the term of this patent is extended or adjusted under 35 U.S.C. 154(b) by 0 days.

(21) Appl. No.: 16/453,872

(22) Filed: Jun. 26, 2019

(65) Prior Publication Data

US 2019/0314729 A1 Oct. 17, 2019

Related U.S. Application Data

(63) Continuation of application No. 15/350,497, filed on Nov. 14, 2016, now Pat. No. 10,376,799.

(60) Provisional application No. 62/255,054, filed on Nov. 13, 2015.

(51) Int. Cl.
*A63G 21/18* (2006.01)
*A63G 31/00* (2006.01)

(52) U.S. Cl.
CPC ..... *A63G 31/007* (2013.01); *A63G 21/18* (2013.01)

(58) Field of Classification Search
CPC ..... A63G 21/00; A63G 21/18; A63G 31/00; A63G 31/007; A63G 31/12; A63B 69/00; A63B 69/0093; A63B 69/125; B63B 1/00; B63B 1/34
USPC ..... 472/116, 117, 128, 134; 482/70–71; 244/130; 104/69–70
See application file for complete search history.

(56) References Cited

U.S. PATENT DOCUMENTS

2003/0004003 A1* 1/2003 Lochtefeld ..... A63B 71/0054 472/117
2009/0137330 A1* 5/2009 Sefchick ..... A63G 21/00 472/117
2013/0130815 A1* 5/2013 Lochtefeld ..... A63B 69/0093 472/128
2013/0184087 A1* 7/2013 Degirmenci ..... A63G 21/18 472/117
2015/0057093 A1* 2/2015 Murphy ..... E04H 4/0006 472/128

* cited by examiner

*Primary Examiner* — Kien T Nguyen
(74) *Attorney, Agent, or Firm* — Buchatler, a professional corp.; Kari L. Barnes

(57) ABSTRACT

A water attraction having one or more inflatable areas and/or features for reducing turbulence of water flow over a ride surface is disclosed. The water attraction includes a ride surface, a water delivery section, and a recovery section. The water delivery section provides water flow on the ride surface. The ride surface may include the assembly of multiple segments and may be fully or partially inflatable. The water delivery section may include one or more water delivery mechanisms, for example, nozzles. A water delivery mechanism may deliver a water flow different from the water flows from other water delivery mechanisms.

12 Claims, 5 Drawing Sheets

INFLATABLE SURFING APPARATUS

CROSS REFERENCE TO RELATED APPLICATION

This application is a continuation of U.S. application Ser. No. 15/350,497, filed Nov. 14, 2016, now U.S. Pat. No. 10,376,799, which claims the benefit of priority under 35 U.S.C. § 119(e) to Provisional Application No. 62/255,054, filed on Nov. 13, 2015, each of which is incorporated by reference in its entirety herein.

SUMMARY

A water attraction or ride vehicle using inflatable materials is disclosed that is shaped or configured such that a rider has a large area for maneuverability without experiencing turbulent water effects. The water attraction of the present invention comprises a ride surface, a water delivery section, and a recovery section, The water delivery section provides water flow on all or part of the ride surface so that users may perform maneuvers upon the flow of water, such as surfing and skimming. The ride surface may be fully or partially inflatable and may be assembled with multiple segments. The water attraction may further include a support portion supporting the ride surface, The support section may also be fully or partially inflatable. The water delivery section may include one or more water delivery mechanisms, for example, nozzles, A water delivery mechanism may deliver a water flow different from the water flows from other water delivery mechanisms. The difference in water flows may cause undesired turbulence, In one embodiment, the water delivery section includes water delivery mechanisms directed in a fa1med-out configuration in order to reduce turbulence. In another embodiment, the gap between two segments of the ride surface may provide a "buffer" where additional water may be flow so that a smooth surface of water is achieved

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims, Component parts shown in the drawings are not necessarily to scale and may be exaggerated to better illustrate the important features of the present invention. In the drawings, like reference numerals designate like parts throughout the different views, wherein:

DETAILED DESCRIPTION

The detailed description of exemplary embodiments herein makes reference to the accompanying drawings and pictures, which show the exemplary embodiments by way of illustration and its best mode, while these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented, Moreover, any of the functions or steps may be outsourced to or performed by one or more third parties, Furthermore, any reference to singular includes plural embodiments, and any reference to more than one component may include a singular embodiment.

The present invention relates generally to amusement attractions, such as surfing simulators or other wave machines. More particularly, the present invention relates to large surfing attractions that incorporate one or more inflatable sections or areas and with features directed towards reduction of turbulence of water flow over ride surfaces thereof.

Figure 1:
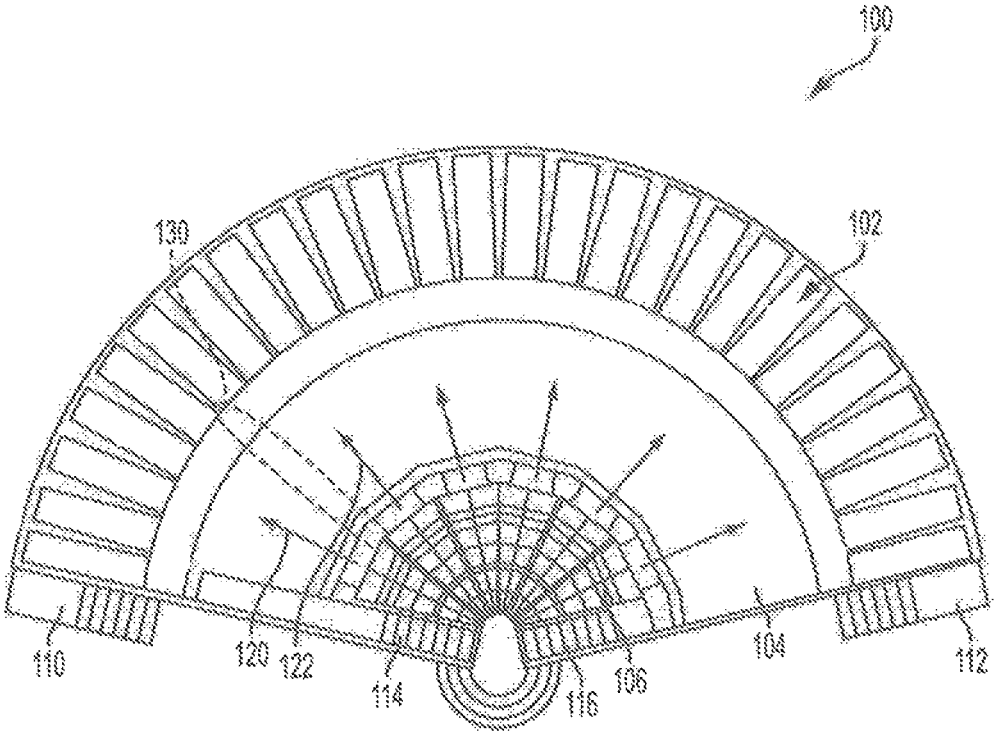
FIG. 1 shows a perspective view of surfing attraction configured in the shape of a portion of a circle according to an embodiment of the present invention.

FIG. 1 illustrates a perspective view of a surfing attraction 100 that is configured to be substantially in the shape of a portion of a circle. The surfing attraction 100 may be operated by directing a flow of water over all or a portion of the surfing attraction 100 so that users upon the surfing attraction 100 may surf, skim, or otherwise perform maneuvers upon the flow of water, either using a ride vehicle such as a board or not, in varying embodiments, Although the surfing attraction 100 is depicted having a particular shape, orientation, configuration, and/or utilize features or operation in FIG. 1, alternative embodiments may utilize any of a variety of alternative shapes, orientations, configurations, features, and/or operation.

The surfing attraction 100 includes a recovery section 102 and a ride surface 104. In varying embodiments, the recovery section 102 and/or the ride surface 104 may be made up or constructed of one or more component parts that are subsequently fastened or connected together in order to form the final desired shape. A water delivery section 106 is also part of the surfing attraction 100 and, during operation, provides a flow of water across all or a part of the ride surface 104 to the recovery section 102. Users may perform maneuvers upon this flow of water on the ride surface 104, such as surfing maneuvers, skimming maneuvers, etc. One or more entry or exit zones (110, 112, 114, 116) may be provided that allow a user to enter and/or exit from the surfing attraction 100. As shown, entry/exit zones (110, 112) may be disposed adjacent or connected with the recovery section 102 to allow users to enter and/or exit from such recovery section 102, Likewise, as shown, entry/exit zones (114, 116) may be disposed adjacent or connected with the ride surface 104 and/or the water delivery section 106 to allow users to enter and/or exit from such ride surface 104 and/or water delivery section 106.

Figure 2:
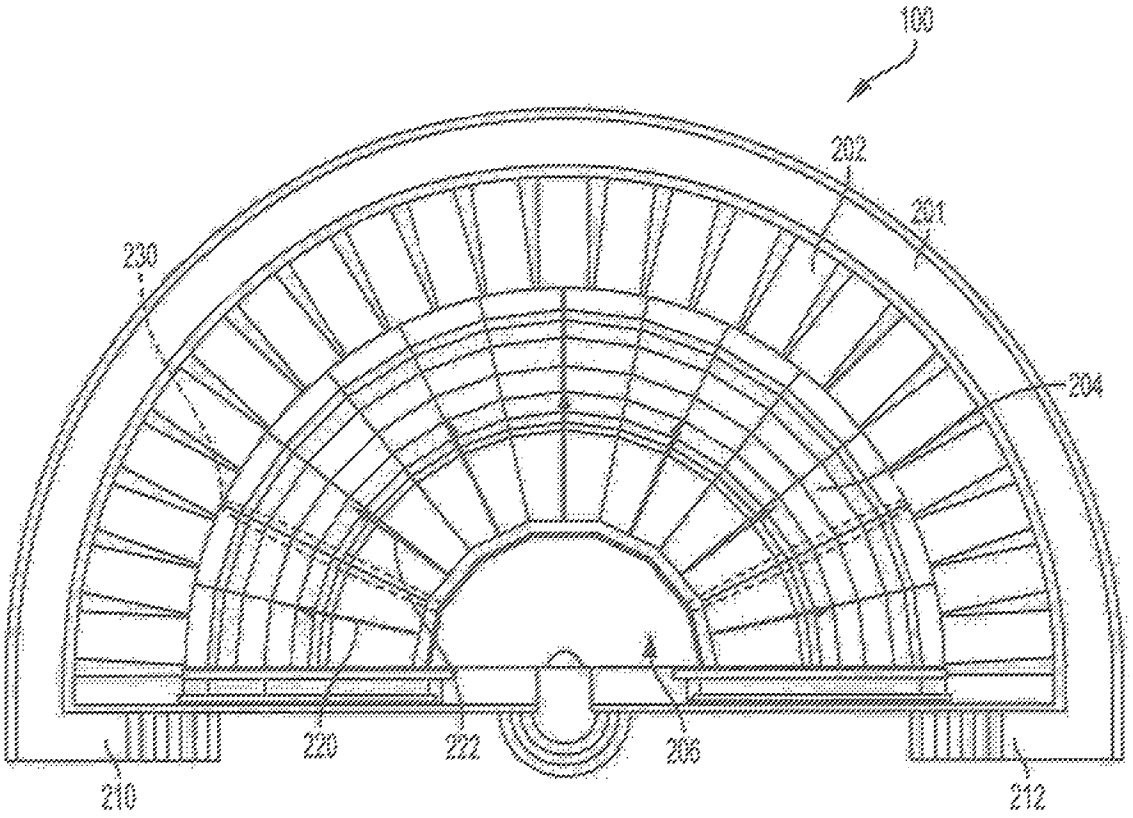
FIG. 2 shows a perspective view of surfing attraction configured in the shape of a half-circle according to an embodiment of the present invention.

The ride surface 104 and/or recovery section 102 may be configured in a particular shape and/or orientation, as shown in FIG. 1, for example, a portion of a circle. Such a configuration may allow for multiple users to ride upon the ride surface 104 simultaneously, for example, due to the larger surface area of the ride surface 104. Such a configuration may also or alternatively allow for a single user to ride upon the ride surface 104, but may allow the user increased maneuverability due to the shape and/or size of the surface area of the ride surface 104, In an alternative embodiment, greater or smaller portions of a circle may be configured for the ride surface 104 and/or the recovery section 102, for example, as seen In FIG. 2. Indeed, any of a variety of possible shapes, sizes, configurations, or other orientations may be used as desired in alternative embodiments, As discussed in greater detail herein, the size, shape, and/or other configuration of the ride surface 104 may require a plurality of water delivery mechanisms, such as nozzles, to operate and flow water over all or a portion of the ride surface 104, As shown, a first one or more water delivery mechanisms may provide a first flow or volume of water 120 upon the ride surface 104 while a second one or more water delivery mechanisms may provide a second flow or volume of water 122 upon the ride surface 104 in an adjacent area. It may be undesirable, in certain embodiments, for the flow of water upon the ride surface 104 to vary upon its surface, for example, because it may introduce an area of turbulence 130 at such intersections of different water flows (120, 122). Thus, as described in greater detail herein, certain aspects, features, and/or operation of the water delivery section 106 and/or the ride surface 104 may be provided to eliminate or reduce such turbulence.

FIG. 2 shows a perspective view of surfing attraction 200 configured in the shape of a half-circle, The surfing attraction 200 may include features that are the same as or similar to those discussed throughout, for example, in FIG. 1. The surfing attraction 200 is in the shape of a half-circle and thus has a slightly modified configuration or shape from that previously discussed for FIG. 1. Alternative embodiments may utilize any of a variety of possible shapes, Similar to the previous discussion, The surfing attraction 200 may be operated by directing a flow of water over all or a portion of the surfing attraction 200 so that users upon the surfing attraction 200 may surf skim, or otherwise perform maneuvers upon the flow of water, either using a ride vehicle such as a board or not, in varying embodiments. Although the surfing attraction 200 is depicted having a particular shape, orientation, configuration, and/or utilize features or operation in FIG. 2, alternative embodiments may utilize any of a variety of alternative shapes, orientations, configurations, features, and/or operation.

The surfing attraction 200 includes a recovery section 202 and a ride surface 204, An entrance/exiting/other pathway 201 is disposed around a perimeter of all or some of the recovery section 202. In varying embodiments, the recovery section 202 and/or the ride surface 204 may be made up or constructed of one or more component parts that are subsequently fastened or connected together in order to fom1 the final desired shape. A water delivery section 206 is also part of the surfing attraction 200 and, during operation, provides a flow of water across all or a part of the ride surface 204 to the recovery section 202. Users may perform maneuvers upon this flow of water on the ride surface 204, such as surfing maneuvers, skimming maneuvers, etc, One or more entry or exit zones (210, 212) may be provided that allow a user to enter and/or exit from the surfing attraction 200. As shown, entry/exit zones (210, 212) may be disposed adjacent or connected with the recovery section 202 and/or connected with the pathway 201 to allow users to enter and/or exit from such recovery section 202 and/or enter and/or exit from the pathway 201, for example, if a user was merely using the pathway 201 to view other users upon the surfing attraction 200.

The ride surface 204 and/or recovery section 202 may be configured in a particular shape and/or orientation, as shown in FIG. 2, for example, a half-circle. Such a configuration may allow for multiple users to ride upon the ride surface 204 simultaneously, for example, due to the larger surface area of the ride surface 204. Such a configuration may also or alternatively allow for a single user to ride upon the ride surface 204, but may allow the user increased maneuverability due to the shape and/or size of the surface area of the ride surface 204, In an alternative embodiment, greater or smaller portions of a circle may be configured for the ride surface 204 and/or the recovery section 202. Indeed, any of a variety of possible shapes, sizes, configurations, or other orientations may be used as desired in alternative embodiments.

Figure 3:
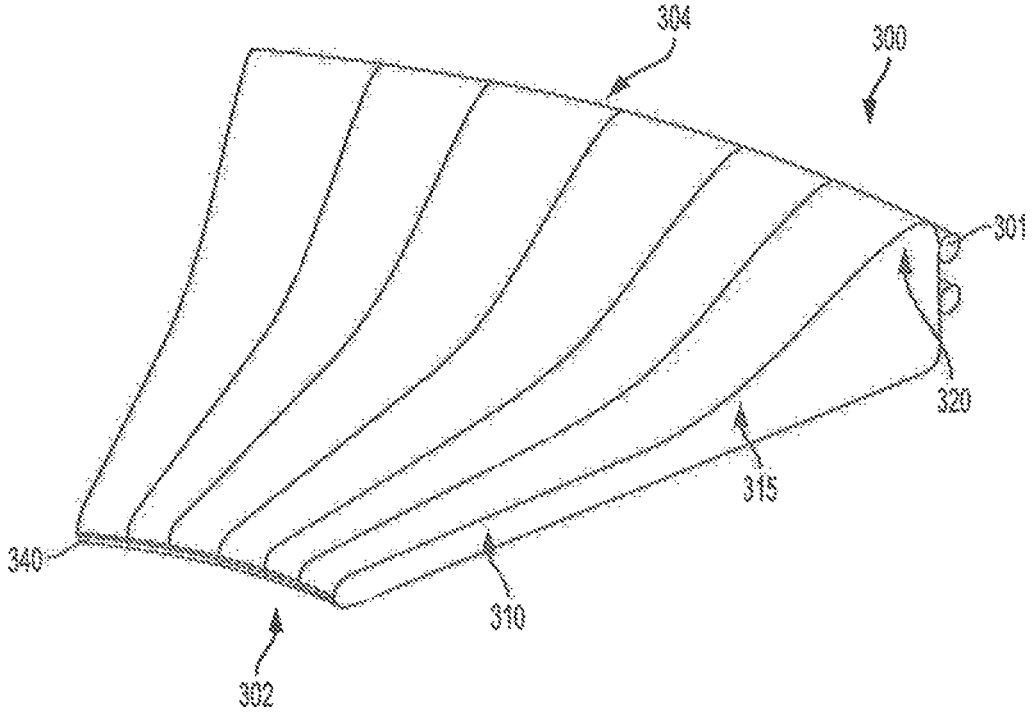
FIG. 3 shows a portion of a surfing attraction to be configured as an underlying part of a ride surface according to an embodiment of the present invention.

As discussed in greater detail herein, the size, shape, and/or other configuration of the ride surface 204 may require a plurality of water delivery mechanisms, such as nozzles, to operate and flow water over all or a portion of the ride surface 204, As shown, a first one or more water delivery mechanisms may provide a first flow or volume of water 220 upon the ride surface 204 while a second one or more water delivery mechanisms may provide a second flow or volume of water 222 upon the ride surface 204 in an adjacent area. It may be undesirable, in certain embodiments, for the flow of water upon the ride surface 204 to vary upon its surface, for example, because it may introduce an area of turbulence 230 at such intersections of different water flows (220, 222). Thus, as described in greater detail herein, certain aspects, features, and/or operation of the water delivery section 206 and/or the ride surface 204 may be provided to eliminate or reduce such turbulence, FIG. 3 shows a portion 300 of a surfing attraction to be configured as an underlying part of a ride surface. The surfing attraction and/or the ride surface may contain features that are the same as or similar to those discussed throughout. For example, the ride surface may be configured to be fully or partially inflatable, for example, using a drop-stitch material. The drop-stitch material may be configured to inflate flat in certain embodiments. In such an embodiment, a ride surface that is fully or partially inflatable may allow for a more comfortable surface for a user to perform maneuvers thereon, particularly upon losing balance and making physical contact with the ride surface. In certain embodiments, the ride surface (inflatable or otherwise) may provide enough support, stability, and/or comfort features to be used without any underlying parts, FIG. 3 illustrates the portion 300 of an embodiment of a surfing attraction that utilizes an underlying part to be disposed underneath one or more segments of a ride surface, as discussed in greater detail below.

The portion 300 may be made of any of a variety of materials, such as foam, plastic, rubber, etc. In certain embodiments, the portion 300 may be configured to be fully or partially inflatable. Thus, in some embodiments, both the portion 300 and any other segment of a ride surface that is disposed above or otherwise connected or adjacent to the portion 300 may be inflatable. In other embodiments, the ride surface may be inflatable and the portion 300 not configured to be inflatable. A front area 302 of the portion 300 may be configured to connect to an area adjacent to a water delivery section of a surfing attraction, such as water delivery section 106 of FIG. 1. Likewise, a rear area 304 of the portion 300 may be configured to connect to an area adjacent to a recovery section of a surfing attraction, such as the recovery section 102 of FIG. 1. Thus, for the embodiment illustrated, the portion 300 may be configured to be disposed between a water delivery section and a recovery section of a surfing attraction, such that a ride surface (inflatable or otherwise) may be disposed thereover or thereon. In certain embodiments, the portion 300 may provide additional support or cushion for a user riding upon its connected ride surface.

Figure 4:
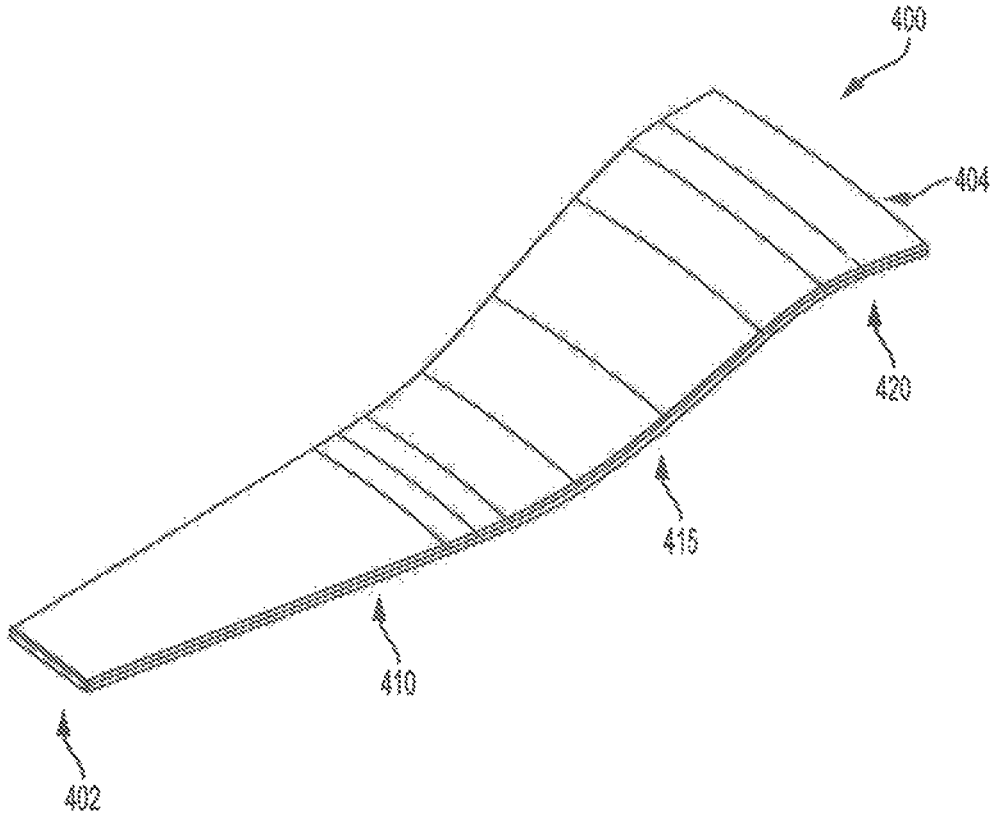
FIG. 4 shows a segment of a ride surface for a surfing attraction according to an embodiment of the present invention.

The portion 300 has a thinner profile at a first section 310 to be disposed near the water delivery section. The portion 300 has a raised profile at a second section 315 to be disposed further away from the water delivery section and concludes at an even more raised profile at a third section 320 to be disposed near the recovery section. Thus, as shown, a profile for the portion 300 may provide the overall profile for the ride surface of the surfing attraction, for example, the ride surface 102 of FIG. 1. In this fashion, the ride surface of a surfing attraction may have its overall profile defined by the portions 300 that are disposed underneath one or more ride surface segments, for example, as illustrated in FIG. 4. Such a configuration may be desirable, particularly for inflatable ride surface segments, since the overall shape or profile for a surfing attraction may be defined by underlying portions, such as portion 300 that are constructed out of materials more easily shaped than inflatable materials. A connecting element 340 may be disposed at the front area 302 of the portion 300 for its connection with another component of the surfing attraction, such as the water delivery section. Likewise, a second connecting element and/or barrier or stabilizing element 301, for example, a perimeter bar for helping hold a desired shape or position of the portion 300 or other elements of a surfing attraction, may be disposed near a rear area 304 of the portion 300. As previously mentioned, multiple portions 300 may be connected with one another, for example, along their sides, in order to construct a complete underlying profile upon which one or more ride surface segments (such as ride surface segment 400 of FIG. 4) may be disposed thereon. These multiple portions 300 may be used to fom1 partial circles, half-circles, or any other desired shape in varying embodiments.

FIG. 4 shows a ride surface segment 400 for a surfing attraction. The surfing attraction and/or various features or components thereof may include the same or similar features to those discussed throughout. For example, as previously discussed, the ride surface segment 400 may be provided upon an underlying portion, such as portion 300 of FIG. 3. The ride surface segment 400 may be partially or fully inflatable, such as using a drop-stitch material.

The ride surface segment 400 has a first end 402, which may be a front end, and a second end 404, which may be a rear end. The first end 402 may be configured to be located near or adjacent to a water delivery section of a surfing attraction and the second end 404 may be configured to be located near or adjacent to a recovery section of a surfing attraction. In some embodiments, the ride surface segment 400 may be configured to have one profile or thickness along its length and/or width. For example, if an underlying part, such as the portion 300 discussed for FIG. 3, is used to aid in defining a shape or profile of the overall ride surface for a surfing attraction, the ride surface segment 400 may merely be laid upon a top of the underlying part such that the overall ride surface retains the shape of the underlying part rather than being impacted by any specific profile of the ride surface segment 400. In an alternative embodiment, the ride surface segment 400 may have varying degrees of thickness, shapes, or other profile characteristics as desired. As shown in FIG. 4, for example, a first section 410 of the ride surface segment 400 may be configured to be connected or otherwise adjacent to the first section 310 of the portion 300 of FIG. 3. Likewise, in the embodiment shown in FIG. 4, a second section 415 of the ride surface segment 400 may be configured to be connected or otherwise adjacent to the second section 315 of the portion 300 and a third section 420 of the ride surface segment 400 may be configured to be connected or otherwise adjacent to the third section 320 of the portion 300 of FIG. 3.

Figure 5:
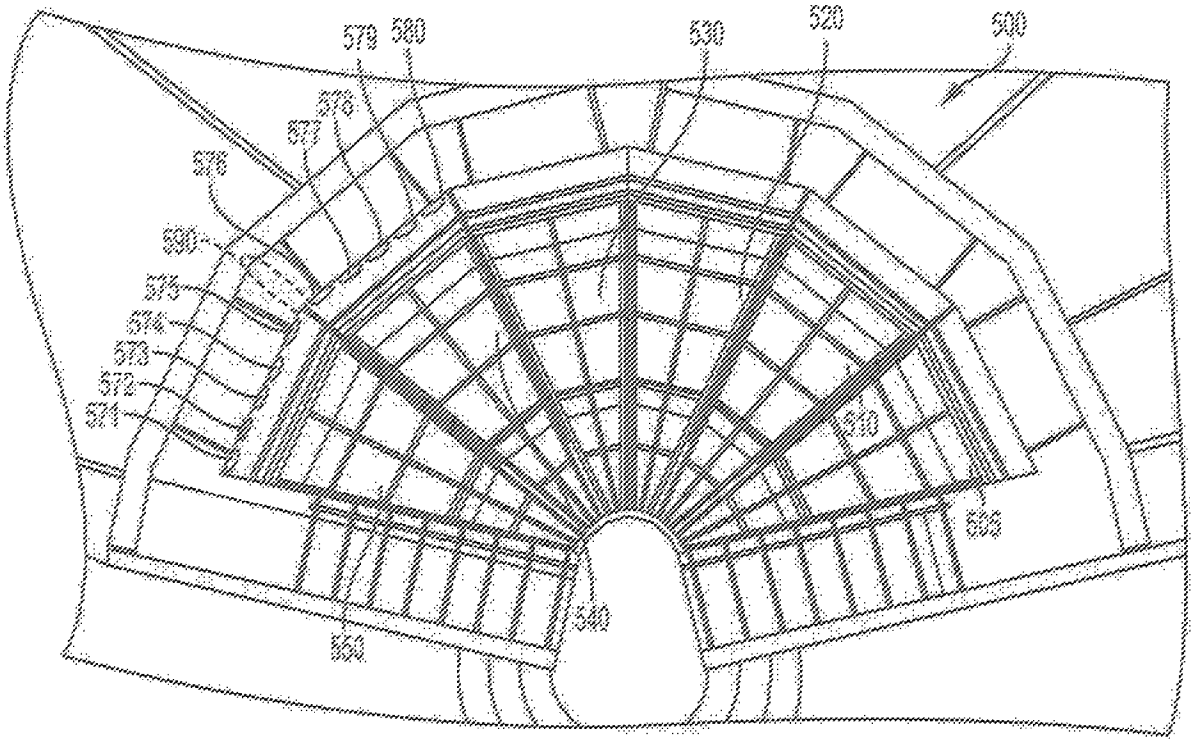
FIG. 5 shows a zoomed-in view of a water delivery section of a surfing attraction for reduction of turbulence according to an embodiment of the present invention.

FIG. 5 shows a zoomed-in view of a water delivery section 500 of a surfing attraction for reduction of turbulence. The water delivery section 500 includes one or more water delivery mechanisms (505, 510, 520, 530, 540, 550), The one or more water delivery mechanisms may be oriented in a configuration matching that of a ride surface, such as the ride surface 104 of FIG. 1. In this fashion, larger shapes or configurations of a ride surface may be adequately provided with a flow of water thereon and in a desired direction of flow by one or more of the water delivery mechanisms (505, 510, 520, 530, 540, 550). Although six water delivery mechanisms (505, 510, 520, 530, 540, 550) are specifically illustrated in FIG. 5, any of a variety of water delivery mechanisms may be used in an alternative embodiment.

Each water delivery mechanism may contain one or more water delivery elements configured to provide a flow of water upon a ride surface of the surfing attraction. For example, for water delivery mechanism 550, a plurality of water delivery elements (571, 572, 573, 574, 575), such as nozzles, are disposed within the water delivery mechanism 550 and each is configured to output a flow or volume of water therefrom. Likewise, for example, for water delivery mechanism 540, a plurality of water delivery elements (576, 577, 578, 579, 580), such as nozzles, are disposed within the water delivery mechanism 540 and each is configured to output a flow or volume of water therefrom. In alternative embodiments, differing rates of flow may be provided for different water delivery elements. For example, in an effort to reduce turbulence due to an increase of fluid or water in a vicinity of area 590, the adjacent water delivery elements, for example, water delivery elements 575 and 576 may output a reduced amount of water compared to one or more water delivery elements (572, 573, 574, 577, 578, 579).

In various embodiments, one or more of the water delivery elements (571, 572, 573, 574, 577, 578, 579, 580) may deliver a water flow different from that from other nozzles. Such difference may be either in direction, amount, pressure, or other characteristic in various embodiments. The difference in water flows and/or the overlap of water flow from one or more of the water delivery elements (571, 572, 573, 574, 577, 578, 579, 580) may cause undesired water turbulence if not controlled according to the features discussed. Likewise, in one embodiment, one or more of the water delivery elements (571, 572, 573, 574, 577, 578, 579, 580) may be configured to spread water more horizontally on the ride surface 104, such as by directing the water in a more "fanned-out" orientation in order to more desirably flow the water of the ride surface.

In one embodiment, the one or more of the water delivery elements (571, 572, 573, 574, 577, 578, 579, 580) may be configured or positioned to match the profile of the ride surface 104 and/or directed in a fanned-out configuration to reduce overlap among flows from the one or more of the water delivery elements (571, 572, 573, 574, 577, 578, 579, 580). In another embodiment, gaps between portions 300, for example as shown in FIG. 3, (caused by connecting portions in a side-by-side manner) and/or gaps between segments 400, for example as shown in FIG. 4 (caused by connecting segments in a side-by-side manner) would create channels to accommodate additional water flow (caused by flow overlap and/or flow difference) so that water turbulence is reduced and a substantially smooth water surface is achieved.

The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. The water attraction of the present invention comprising:

a ride surface, the ride surface shaped in at least a half circle when viewed from above, the ride surface comprises a first portion and a second portion separate from and positioned over the first portion;

a water delivery section; and a recovery section, wherein the first portion creates an elevation change and defining profile of the ride surface and the second portion positioned upon the first portion conforms to a shape of the defining profile, wherein the first portion has a thinner profile at a first section disposed near the water delivery section and a raised profile at a second section that defines an upward taper across the ride surface extending away from the from the water delivery section and a more raised profile at a third section that defines a second upward taper across the ride surface extending away from the water delivery section, wherein the second upward taper is less than the upward taper such that the more raised profile of the third section is less steep than the raised profile of the second section.

2. The water attraction of claim 1, wherein the second portion is inflatable.

3. The water attraction of claim 2, further comprising a connecting element to couple the ride surface to the water delivery section.

4. The water attraction of claim 3, wherein the first portion is comprised of a plurality of segments connected along their sides to define the half circle shape.

5. The water attraction of claim 1, wherein the second portion defines one thickness along its length.

6. The water attraction of claim 1, further comprising a bar positioned along a perimeter of the ride surface to hold a desired position of the ride surface.

7. The water attraction of claim 6, wherein the bar defines a partial circle.

8. The water attraction of claim 7, wherein the water delivery section comprises a plurality of water delivery elements.

9. The water attraction of claim 8, wherein one or more of the plurality of water delivery elements deliver a water flow different from that from other one or more of the plurality of water delivery elements.

10. The water attraction of claim 9, wherein the plurality of water delivery elements are configured to spread water horizontally on the ride surface in a fanned-out orientation.

11. The water attraction of claim 10, wherein the one or more of the plurality of water delivery elements are configured to match the ride surface and wherein the fanned-out orientation is configured to reduce overlap among flows from the one or more of the plurality of water delivery elements.

12. The water attraction of claim 11, further comprising a substantially smooth water surface on the ride surface.

* * * * *